US008065880B2

(12) United States Patent
Ishizaka et al.

(10) Patent No.: US 8,065,880 B2
(45) Date of Patent: Nov. 29, 2011

(54) PREMIXED COMBUSTION BURNER FOR GAS TURBINE

(75) Inventors: Koichi Ishizaka, Takasago (JP); Yutaka Kawata, Takasago (JP); Satoshi Takiguchi, Takasago (JP); Satoshi Tanimura, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 1129 days.

(21) Appl. No.: 11/655,059

(22) Filed: Jan. 19, 2007

(65) Prior Publication Data

US 2010/0263381 A1 Oct. 21, 2010

(30) Foreign Application Priority Data

Apr. 14, 2006 (JP) ..... 2006-112217

(51) Int. Cl.
*F02C 1/00* (2006.01)

(52) U.S. Cl. ..... 60/737; 60/748

(58) Field of Classification Search ..... 60/737, 60/748; 431/354; 239/405, 406
See application file for complete search history.

(56) References Cited

U.S. PATENT DOCUMENTS

| | | | | |
|---|---|---|---|---|
| 3,930,369 | A * | 1/1976 | Verdouw | 60/737 |
| 5,251,447 | A * | 10/1993 | Joshi et al. | 60/737 |
| 6,141,967 | A | 11/2000 | Angel et al. | |
| 7,669,421 | B2 * | 3/2010 | Saitoh et al. | 60/748 |
| 2003/0084667 | A1 | 5/2003 | Gerendas et al. | |
| 2004/0142294 | A1 * | 7/2004 | Niass et al. | 431/278 |
| 2007/0031771 | A1 | 2/2007 | Blomeyer | |

FOREIGN PATENT DOCUMENTS

| | | |
|---|---|---|
| EP | 1 308 673 | 5/2003 |
| EP | 1 406 047 | 4/2004 |
| JP | 54-52507 | 4/1979 |
| JP | 7-217888 | 8/1995 |
| JP | 2002-213746 | 7/2002 |
| JP | 2003-083541 | 3/2003 |
| JP | 2004-101081 | 4/2004 |

(Continued)

OTHER PUBLICATIONS

German Office Action (with English translation) issued Jul. 21, 2009 in counterpart German Application No. 102007004394.7.

(Continued)

*Primary Examiner* — Ehud Gartenberg
*Assistant Examiner* — Vikansha Dwivedi
(74) *Attorney, Agent, or Firm* — Wenderoth, Lind & Ponack, L.L.P.

(57) ABSTRACT

A premixed combustion burner for a gas turbine can efficiently premix fuel and air to produce fuel gas having a uniform concentration, while reliably achieving prevention of flash back by making the flow rate of fuel gas substantially uniform. The premixed combustion burner for a gas turbine has a fuel nozzle, a burner cylinder arranged so as to surround the fuel nozzle and form an air passageway between itself and the fuel nozzle, and swirler vanes that are arranged along an axial direction of the fuel nozzle in a plurality of positions around the circumferential direction of an outer circumference surface of the fuel nozzle. The swirler vanes gradually curve from an upstream side to a downstream side to spin the air traveling within the air passageway from the upstream side to the downstream side. A cutaway section is provided in a rear edge section on an inner circumference side of the swirler vanes.

20 Claims, 8 Drawing Sheets

FOREIGN PATENT DOCUMENTS

| | | |
|---|---|---|
| JP | 2005-195284 | 7/2005 |
| JP | 2006-500544 | 1/2006 |
| JP | 2006-29675 | 2/2006 |
| JP | 2006-078127 | 3/2006 |
| WO | 2004/029515 | 8/2004 |
| WO | 2005/019733 | 3/2005 |

OTHER PUBLICATIONS

Japanese Office Action dated Aug. 27, 2010 in corresponding Japanese Patent Application No. 2006-112217 with English translation.
German Office Action issued Mar. 4, 2011 in corresponding German Patent Application No. 102007004394.7 w/English translation.

* cited by examiner

PREMIXED COMBUSTION BURNER FOR GAS TURBINE

BACKGROUND OF THE INVENTION

1. Field of the Invention

The present invention relates to a premixed combustion burner for a gas turbine. The present invention is devised so that fuel and air can be efficiently premixed to produce fuel gas having a uniform concentration, while achieving reliable prevention of flash back (back fire) by making the flow rate of fuel gas substantially uniform.

2. Description of Related Art

As a premixed combustion burner for a gas turbine, for example, the premixed combustion burner disclosed in Japanese Translation of a PCT International Application, Publication No. 2006-500544 is commonly known.

The invention disclosed in the above patent document is to prevent flash back by lowering the fuel concentration on an inner circumference side (radial direction inner side) of an air passageway.

However, since a total amount of fuel injected into the air passageway per unit time does not change, the fuel concentration in another area (for example, the area on the outer circumference side of the air passageway) increases inversely to the reduction made in the fuel concentration on the inner circumference side of the air passageway, and flame temperature rises on the downstream side, resulting in a possible increase in NOx.

BRIEF SUMMARY OF THE INVENTION

In consideration of the circumstance described above, an object of the present invention is to provide a premixed combustion burner for a gas turbine that can efficiently premix fuel and air to produce fuel gas having a uniform concentration, while reliably achieving prevention of flash back by making the flow rate of fuel gas substantially uniform.

In order to solve the problem described above, the present invention employs following means.

The premixed combustion burner for a gas turbine according to the present invention has: a fuel nozzle; a burner cylinder arranged so as to surround the fuel nozzle and form an air passageway between itself and the fuel nozzle; and swirler vanes that are arranged along an axial direction of the fuel nozzle in a plurality of positions around the circumferential direction of an outer circumference surface of the fuel nozzle and that gradually curve from an upstream side to a downstream side to spin the air traveling within the air passageway from the upstream side to the downstream side, and a cutaway section is provided in a rear edge section on an inner circumference side of the swirler vane.

According to such a premixed combustion burner for a gas turbine, compressed air flowing along a root section of a vane front side surface of each of the swirler vanes flows through the cutaway section to the downstream side, and a layer of the compressed air flowing faster than the spiral air flow is formed on the inner circumference side of the air passageway. Moreover, the compressed air flowing along the portion other than the root section of the vane front side surface of the respective swirler vanes travels on the vane back side surface and vane front side surface of the respective swirler vanes from the front edge to the rear edge of the respective swirler vanes, giving a spiral force to the compressed air, so that a spiral air flow is formed on the outer circumference side of the air passageway. The layer of compressed air and the spiral air flow act on each other on the downstream side of the swirler vane (in other words, on the downstream side of the air passageway) and generate a vortex air flow as a result. Then fuel concentration in the air passageway is made uniform in the radial direction by this vortex air flow, preventing any occurrence of flash back (back fire).

In the premixed combustion burner for a gas turbine described above, it is further preferable that a height of the cutaway section be set to 3% to 20% of the maximum vane height of the swirler vane.

According to such a premixed combustion burner for a gas turbine, since the height of the cutaway section is set to 3% to 20% of the maximum vane height of the swirler vane and an optimum spiral air flow is generated, fuel concentration in the air passageway in the radial direction can be made more uniform, and the occurrence of flash back can be more reliably prevented.

In the case where the height of the cutaway section is set lower than 3% of the maximum vane height of the swirler vane, the thickness of the compressed air formed on the inner circumference side of the air passageway becomes thinner, and fuel concentration in the air passageway in the radial direction becomes higher, resulting in the possibility of flash back occurrence.

Moreover, in the case where the height of the cutaway section is set higher than 20% of the maximum vane height of the swirler vane, the spiral force given by the respective swirler vanes is reduced and fuel concentration in the air passageway in the radial direction cannot be made uniform, resulting in the possibility of flash back occurrence.

In the premixed combustion burner for a gas turbine described above, it is further preferable that injection holes for fuel injection be provided in the vane back side surface and/or the vane front side surface of the swirler vane, and that the diameter of the injection hole positioned on the radial direction outer side be set greater than the diameter of the injection hole positioned on the radial direction inner side.

According to such a premixed combustion burner, since the diameter of the injection hole positioned on the radial direction outer side is set greater than the diameter of the injection hole positioned on the radial direction inner side, fuel concentration in the air passageway in the radial direction can be made more uniform, and the occurrence of flash back (back fire) can be more reliably prevented.

In the premixed combustion burner for a gas turbine described above, it is further preferable that the injection hole positioned on the radial direction inner side be provided in a position proximal to the cutaway section and that enables the fuel injected from the injection hole to flow along the vane back side surface and/or the vane front side surface of the respective swirler vanes to the rear edge of the respective swirler vanes.

According to such a premixed combustion burner for a gas turbine, since the injection hole positioned on the radial direction inner side is provided in a position proximal to the cutaway section and that enables the fuel injected from these injection holes to flow along the vane back side surface and the vane front side surface of the respective swirler vanes together with the spiral air flow towards the downstream side, mixing of fuel and air in the vicinity of a top surface of the fuel nozzle can be prevented, and exposure of the top surface of the fuel nozzle to flame can be avoided.

In the premixed combustion burner for a gas turbine described above, it is further preferable that the injection holes be provided in positions that are displaced from one another in the vane height direction and/or vane length direction of the swirler vane.

According to such a premixed combustion burner for a gas turbine, since the injection holes are provided in the positions that are displaced from one another in the vane height direction and/or vane length direction of the swirler vane (offset positions), a reduction in fuel supply pressure can be prevented, and stable fuel injection can be carried out.

In the premixed combustion burner for a gas turbine described above, it is further preferable that a chamfer section be provided on a rear edge section tip side and/or on a root side of the swirler vane.

According to such a premixed combustion burner for a gas turbine, since the chamfer sections are provided on the rear edge section of the swirler vane, and a spiral flow is generated at the rear of these chamfer sections to further promote mixing of the layer of the compressed air and the spiral air flow, fuel concentration in the air passageway in the radial direction can be made more uniform, further preventing the occurrence of flash back.

In the premixed combustion burner for a gas turbine described above, it is further preferable that a ring member be provided on a radial direction inner side of the cutaway section.

According to such a premixed combustion burner for a gas turbine, since the spiral force acting on the inner circumference side of the air passageway is weakened by the ring member, enhancing the effect of the cutaway section and thereby promoting the mixing of the layer of the compressed air and the spiral air flow, fuel concentration in the air passageway in the radial direction can be made more uniform, and the occurrence of flash back can be further prevented.

Moreover, since the entire inner circumference side of the cutaway section is held (supported) by the ring member, the rigidity of the entire swirler vane can be enhanced.

In the premixed combustion burner for a gas turbine described above, it is further preferable that a clearance be provided between an outer circumference side end surface of the swirler vanes and an inner surface of the burner cylinder.

According to such a premixed combustion burner for a gas turbine, since the clearance provides efficient mixing of fuel and air to promote uniformity of the fuel gas, fuel concentration in the air passageway in the radial direction can be made more uniform, and the occurrence of flash back can be further prevented.

A combustor of a gas turbine according to the present invention is provided with the premixed combustion burner for a gas turbine that can efficiently premix fuel and air to produce fuel gas having a uniform concentration while reliably achieving prevention of flash back by making a flow rate of fuel gas substantially uniform.

According to such a combustor for a gas turbine, burnout in the fuel nozzle due to flash back can be prevented, prolonging the life (extending the operating life) of the fuel nozzle and improving the reliability of the combustor, and maintenance intervals can be extended resulting in achieving a reduction in maintenance cost.

A gas turbine according to the present invention is provided with a highly reliable combustor.

According to such a gas turbine, the reliability of an entire gas turbine can be improved.

According to the present invention, fuel and air can be efficiently premixed to produce fuel gas having a uniform concentration, and an effect of reliable prevention of flash back can be achieved by making the flow rate of the fuel gas substantially uniform.

DETAILED DESCRIPTION OF THE INVENTION

Hereinafter, a first embodiment of a premixed combustion burner of a gas turbine according to the present invention is described, with reference to the drawings.

Figure 1:
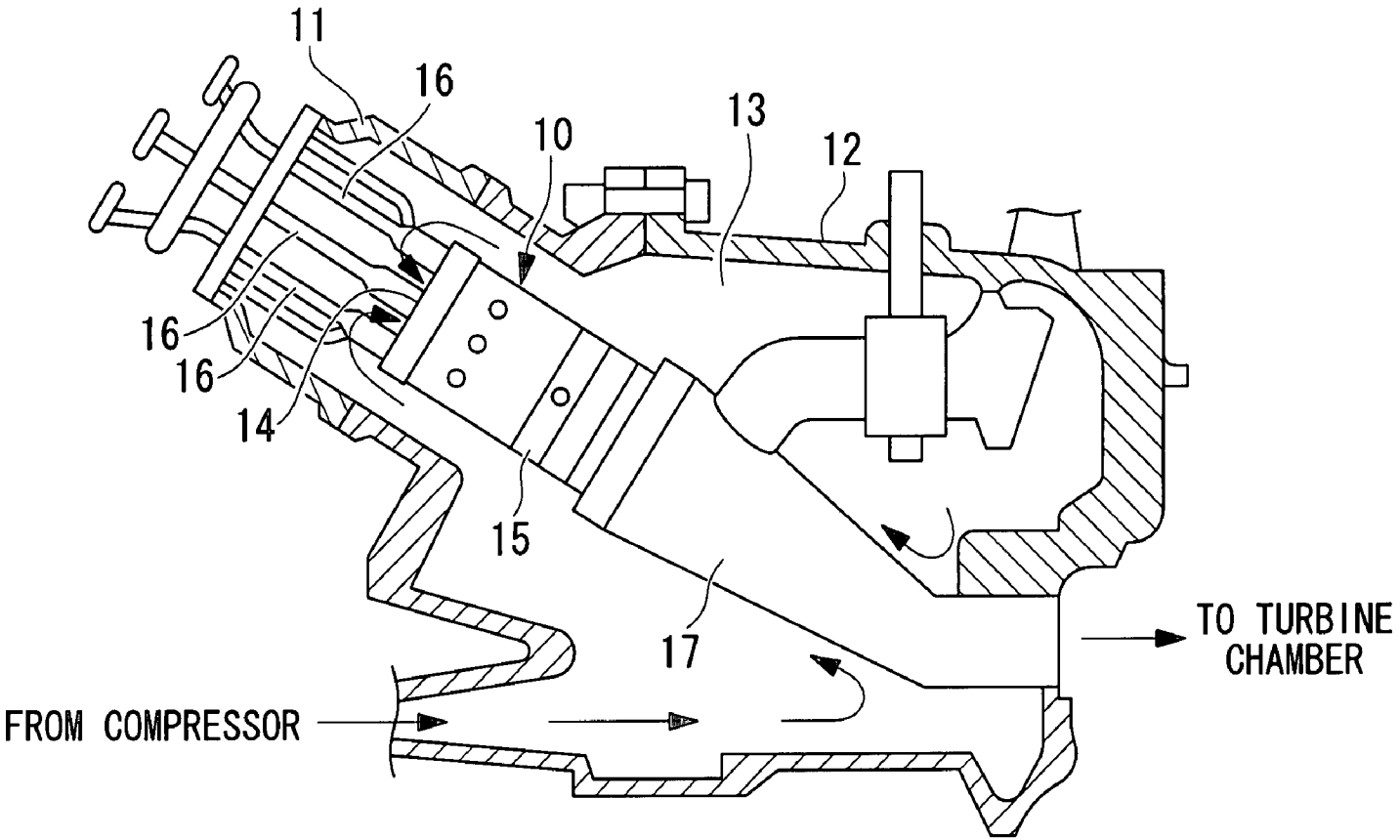
FIG. 1 is a schematic diagram showing a combustor of a gas turbine provided with a premixed combustion burner according to the present invention.

In FIG. 1, a gas turbine (not shown in the diagram) provided with a premixed combustion burner for a gas turbine (hereinafter, referred to as "premixed combustion burner") 18 (refer to FIG. 2) according to the present invention and used for a generator or the like, is constructed with principal members including a compressor (not shown in the diagram), a combustor 10, and a turbine (not shown in the diagram). Many gas turbines have a plurality of combustors, and air compressed by the compressor and fuel supplied into the combustor 10 are mixed and are combusted within each combustor 10 to generate combustion gas at high temperature. This high temperature combustion gas is supplied to the turbine to drive the rotation of the turbine.

As shown in FIG. 1, a plurality of the combustors 10 of the gas turbine is arranged in a ring shape inside a combustor casing 11 (FIG. 1 shows only one of them). The combustor casing 11 and a gas turbine casing 12 are filled with compressed air and they form a compartment 13. Air compressed by the compressor is introduced into this compartment 13. The introduced compressed air enters into the combustor 10 from an air inlet 14 provided on an upstream side of the combustor 10. The compressed air and fuel supplied from a combustion burner 16 are mixed and combusted inside an inner cylinder 15 of the combustor 10. Combustion gas generated as a result of combustion is supplied to a turbine chamber side through a tail pipe 17, thereby rotating a turbine rotor (not shown in the diagram).

Figure 2:
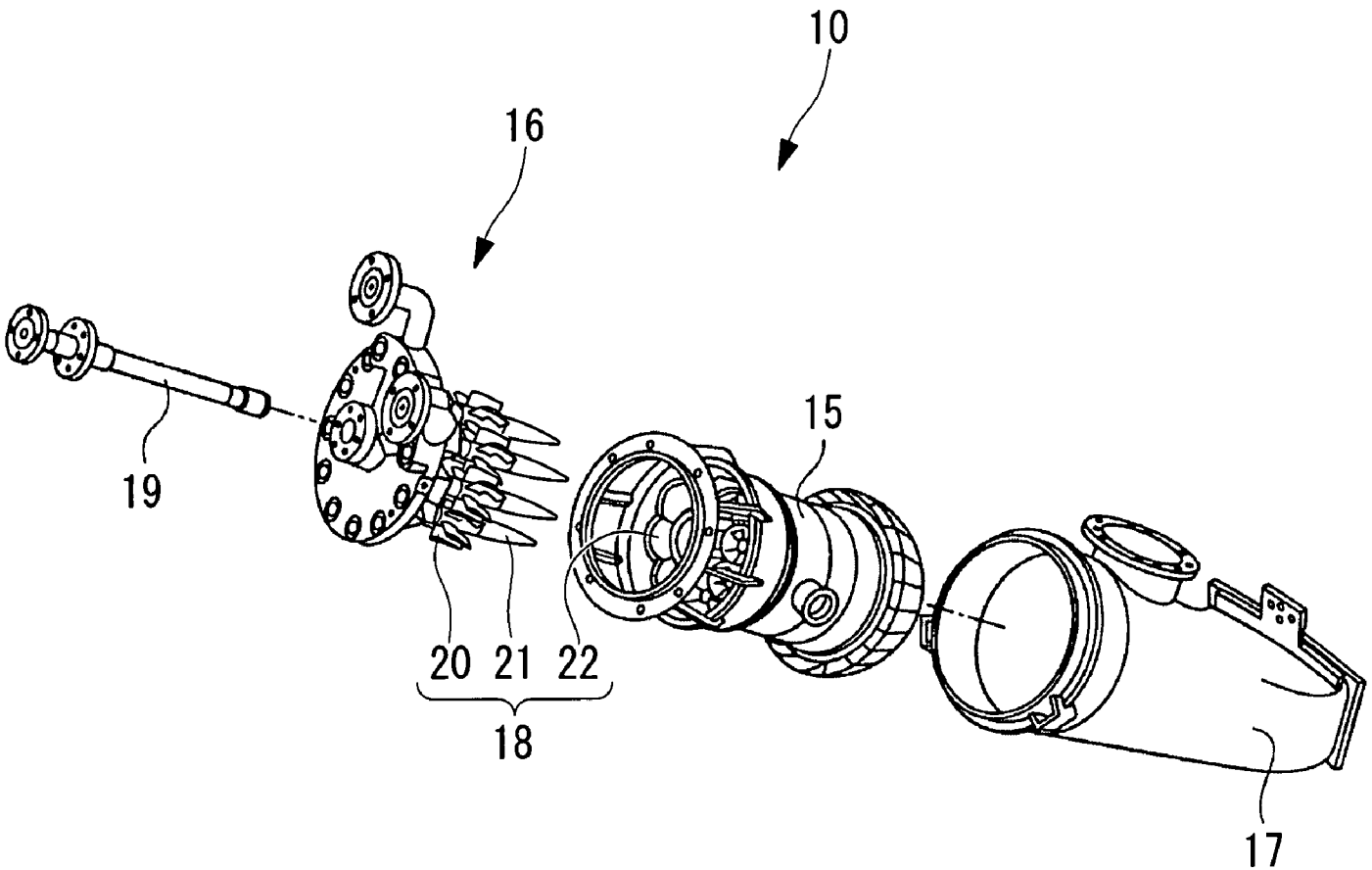
FIG. 2 is an exploded perspective view showing fuel nozzles, an inner cylinder, and a tail pipe of the combustor shown in FIG. 1.

FIG. 2 is a perspective view showing the combustion burner 16, the inner cylinder 15, and the tail pipe 17 separated from each other.

As shown in FIG. 2, the combustion burner 16 has a plurality of premixed combustion burners 18 and a single pilot combustion burner 19.

The plurality of premixed combustion burners 18 are arranged within the inner cylinder 15, surrounding the pilot combustion burner 19 as shown in FIG. 2. The fuel injected from the premixed combustion burners 18 is premixed with the air, the flow of which has been made spiral by swirler vanes 20 of the premixed combustion burners 18 described later, and is combusted inside the inner cylinder 15.

A pilot combustion nozzle (not shown in the diagram) is incorporated into the pilot combustion burner 19.

Figure 3:
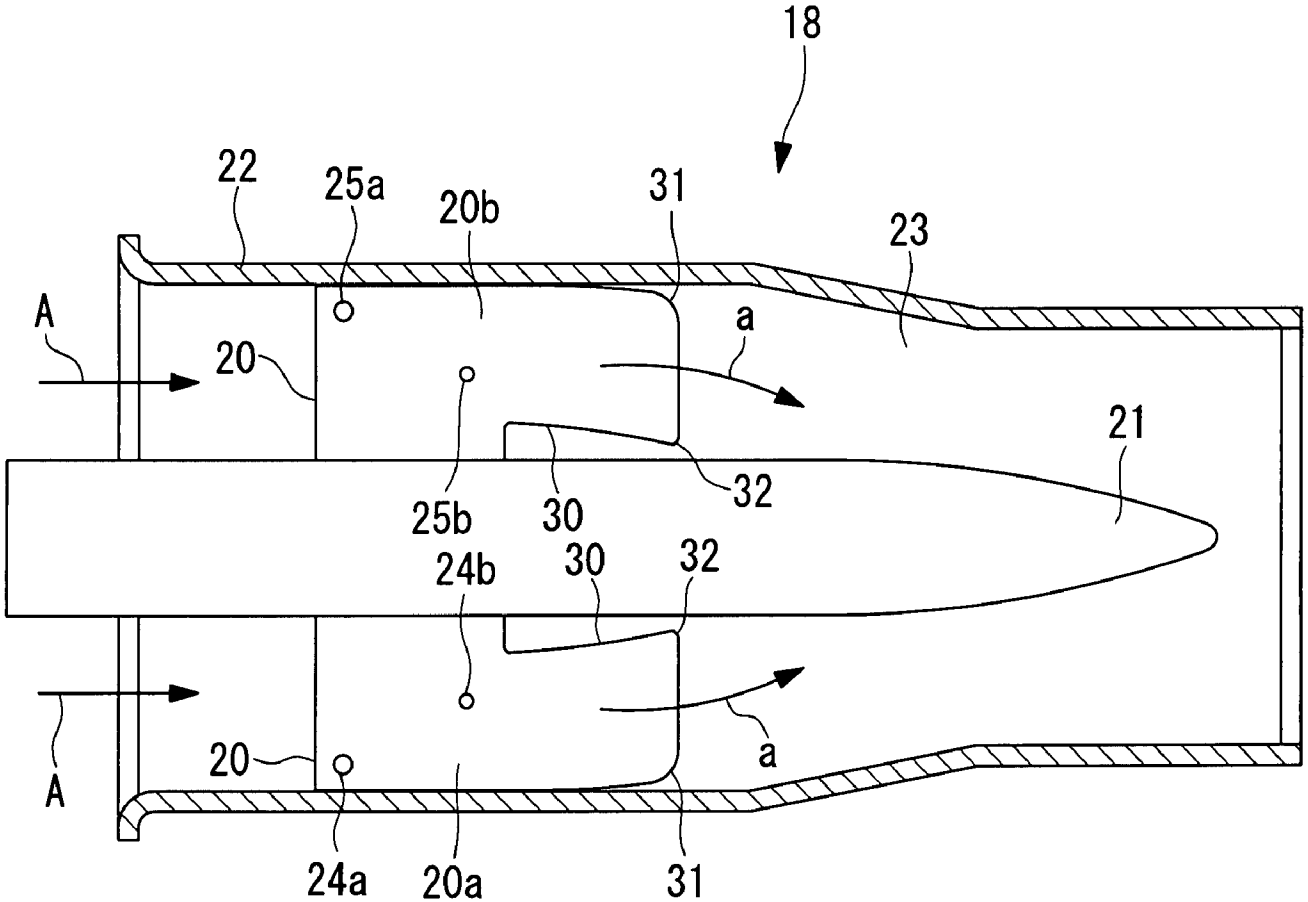
FIG. 3 is a schematic diagram showing a first embodiment of a premixed combustion burner according to the present invention.

As shown in FIG. 3, the premixed combustion burner 18 is constructed with major components including a fuel nozzle 21, a burner cylinder 22, and the swirler vanes 20.

The burner cylinder 22 is concentric with the fuel nozzle 21, and is arranged so as to surround the fuel nozzle 21. Therefore, a ring shaped air passageway 23 is formed between an outer circumferential surface of the fuel nozzle 21 and an inner circumferential surface of the burner cylinder 22.

Compressed air A flows through this air passageway 23 from an upstream side (left side in FIG. 3) to a downstream side (right side in FIG. 1) thereof.

Figure 4A:
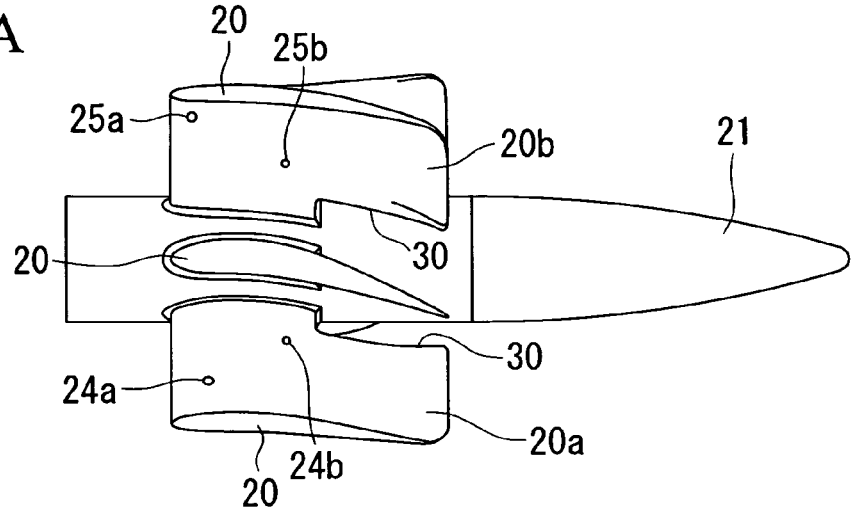
FIG. 4 (*a*) to (*c*) are diagrams that show swirler vanes and fuel nozzles shown in FIG. 3, (a) being a side view, (b) being a front view, and (c) being a perspective view.
Figure 4B:
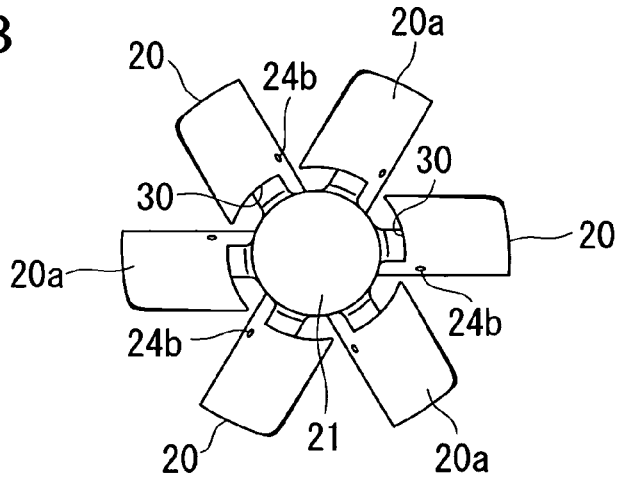
Figure 4C:
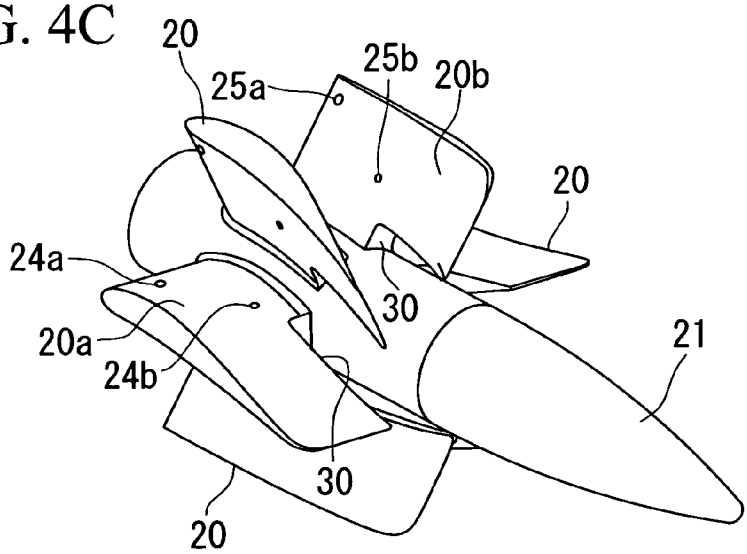

As shown in FIG. 4 (*a*) to FIG. 4 (*c*), the swirler vanes 20 are arranged in a plurality of places (six places in the present embodiment) in a condition radiating outward from the outer circumferential surface of the fuel nozzle 21, and along an axial direction of the fuel nozzle 21.

For the sake of simplicity, in FIG. 3 only two of the swirler vanes 20, those arranged in positions at 0 degree and 180 degree angles around the circumferential direction, are shown (a total of four swirler vanes 20 should actually be seen in the state of FIG. 3).

Figure 5A:
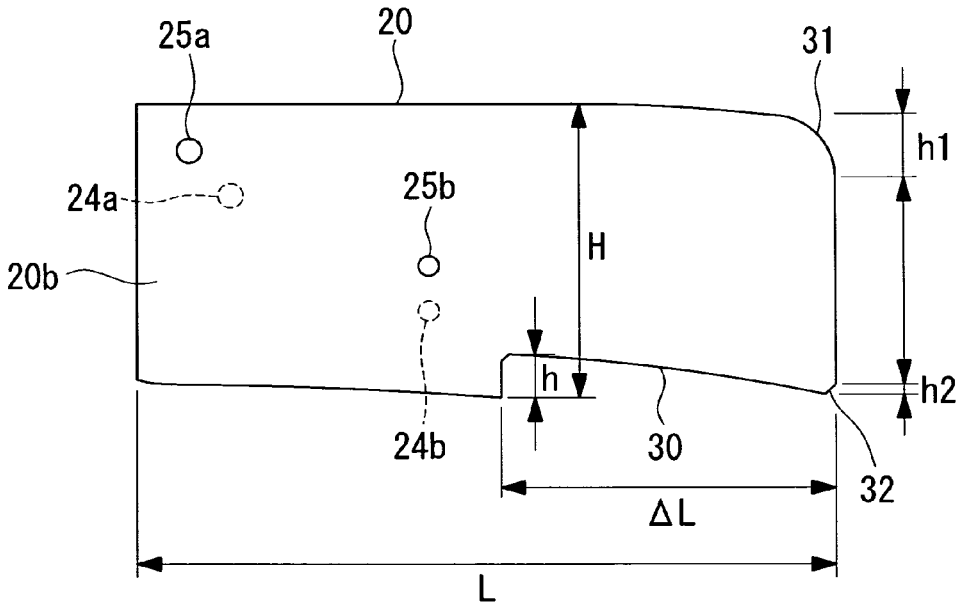
FIGS. 5 (*a*) and (*b*) are diagrams that show the swirler vane shown in FIG. 3 and FIG. 4, (a) being a side view, and (b) being a cross-sectional view.
Figure 5B:
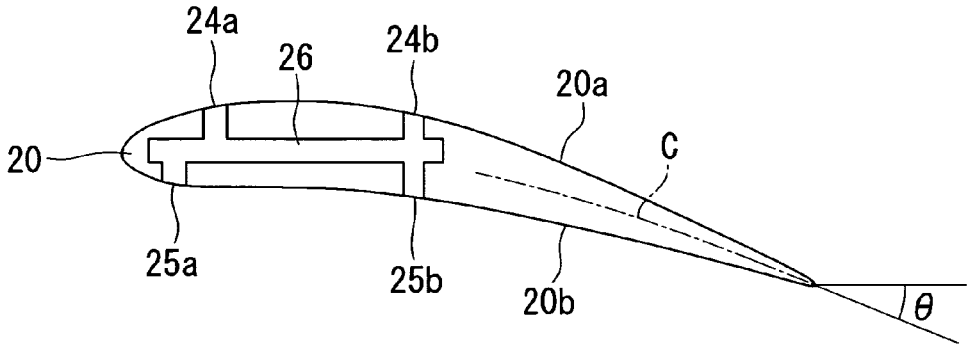

Each of the swirler vanes 20 imparts a spiral force to the compressed air A flowing through the air passageway 23 to turn the compressed air A into a spiral air flow "a". Therefore, in order to be able to spin the compressed air A, each of the swirler vanes 20 is curved as shown in FIG. 5 (*b*) so that an angle θ between a camber line C of the swirler vane 20 and the flow direction of the compressed air A (that is, the axial direction of the fuel nozzle 21) gradually increases as the flow moves from the upstream side to the downstream side, and so that θ at the rear edge of the swirler vanes 20 is between 20° and 30°.

Moreover, cutaway sections 30 are provided in a rear edge section on an inner circumference side (inside in the radial direction: the side closer to the fuel nozzle 21) of each of the swirler vanes 20. A height h of this cutaway section 30 is set at 3% to 20% of the maximum vane height H of the swirler vane 20 (preferably, approximately 15%), and a length ΔL thereof is set at 20% to 50% of the chord length L of the swirler vane 20 (refer to FIG. 5 (*a*)).

It is further preferable that a front edge side end surface of the cutaway section 30 be provided in a position where the angle θ between the camber line C and the flow of the compressed air A is greater than 0° (preferably a position where it is 3°). That is to say, it is preferable that the cutaway section 30 be provided in an area from a position where the angle θ between the camber line C and the flow of the compressed air A is greater than 0° (preferably the position where it is 3°) to the rear edge of the swirler vane 20.

A chamfered section (or R section) 31 is provided on a rear edge section tip side (tip end side) of each of the swirler vanes 20, and a chamfer section (or R section) 32 is provided on a rear edge section root side (root side) of each of the swirler vanes 20. Lengths h1 and h2 of these chamfered sections 31 and 32 in the height direction of the vane are respectively set to a height equal to the height h of the cutaway section 30, that is to say, they are set to 3% to 20% (preferably approximately 15%) of the maximum vane height H of the swirler vane 20.

A plurality of injection holes 24*a* and 24*b* (two of them in the present embodiment) are formed in a vane backside surface 20*a* of each of the swirler vanes 20, and a plurality of injection holes 25*a* and 25*b* (two of them in the present embodiment) are formed in a vane front side surface 20*b* of each of the swirler vanes 20. As shown in FIG. 5 (*a*) and FIG. 5 (*b*), the injection holes 24*a* and 25*a* are provided in the front edge section on the outer circumference side of the swirler vane 20 (the radial outward side: the side furthest from the fuel nozzle 21), and the injection holes 24*b* and 25*b* are provided between the injection holes 24*a* and 25*a* and the cutaway section 30 (that is to say, on the inner circumference side of the injection holes 24*a* and 25*a* and on the outer circumference side of the cutaway section 30 and also on the rear edge side of the injection holes 24*a* and 25*a* and on the front edge side of the cutaway section 30) and proximal to the cutaway section 30. Moreover, the injection hole 24*a* is arranged to the inner circumference side and rear edge side of the injection hole 25*a*, and the injection hole 24*b* is arranged to the inner circumference side of the injection hole 25*b*. The position of the injection hole 24*b* in the axial direction is equal to that of the injection hole 25*b*.

Diameters of the injection holes 24*a* and 25*a* are respectively greater than diameters of the injection holes 24*b* and 25*b*, and the diameters of the injection hole 24*a* and injection hole 25*a* are of substantially equal size, and the diameter of the injection hole 24*b* and injection hole 25*b* are of substantially equal size. Moreover, fuel is supplied respectively to these injection holes 24*a*, 24*b*, 25*a* and 25*b* through a fuel passageway 26 formed inside the swirler vane 20 and through a fuel passageway (not shown in the diagram) formed within the fuel nozzle 21. The fuel injected from the injection holes 24*a*, 24*b*, 25*a* and 25*b* is mixed with the compressed air A to become fuel gas, which is sent into an interior space of the inner cylinder 15 to be combusted.

According to the premixed combustion burner 18 of the present embodiment, the compressed air A flowing along a root section of the vane front side surface 20*b* of each of the swirler vanes 20 flows through the cutaway section 30 to the downstream side, and a layer of the compressed air A flowing faster than the spiral air flow "a" is formed on the inner circumference side of the air passageway 23. Moreover, the compressed air A flowing along the portions, other than the root section, of the vane backside surface 20*a* and the vane front side surface 20*b* of each of the swirler vanes 20 flows on the vane backside surface 20*a* and the vane front side surface 20*b* of each of the swirler vanes 20 from the front edge to the rear edge of each of the swirler vanes 20, and is given a spiral force, and the spiral air flow "a" is formed on the outer circumference side of the air passageway 23. These layer of compressed air A and the spiral air flow "a" act on each other on the downstream side of the swirler vane 20 (that is to say, on the downstream side of the air passageway 23), and generate a vortex air flow as a result. Then fuel concentration in the air passageway 23 is made uniform in the radial direction by this vortex air flow, preventing any occurrence of flash back (back fire).

Moreover, according to the premixed combustion burner 18 of the present embodiment, since the height h of the cutaway section 30 is set to 3% to 20% of the maximum vane height H of the swirler vane 20 (preferably, approximately 15%) so that an optimum vortex air flow is generated, fuel concentration within the air passageway 23 in the radial direction can be made more uniform, and the occurrence of flash back (back fire) can be more reliably prevented.

In the case where the height h of the cutaway section 30 is set lower than 3% of the maximum vane height H of the swirler vane 20, the thickness of the compressed air A formed on the inner circumference side of the air passageway 23 becomes thinner, and fuel concentration in the air passageway 23 in the radial direction becomes higher, resulting in the possibility of flash back (back fire) occurrence.

Moreover, in the case where the height h of the cutaway section 30 is set higher than 20% of the maximum vane height H of the swirler vane 20, the spiral force given by the respective swirler vanes 20 is reduced and fuel concentration in the air passageway 23 in the radial direction cannot be made uniform, resulting in the possibility of flash back (back fire) occurrence.

Furthermore, according to the premixed combustion burner 18 of the present embodiment, since the injection holes 24*b* and 25*b* are provided in positions that are in the vicinity of the cutaway section 30 and that enable the fuel injected from the injection holes 24*b* and 25*b* to flow along the vane backside surface 20*a* and the vane front side surface 20*b* of the respective swirler vanes 20 together with the spiral air flow "a" towards the downstream side, mixing of fuel and air in the vicinity of the top surface of the fuel nozzle 21 can be prevented, and exposure of the top surface of the fuel nozzle 21 to flame can be prevented.

Furthermore, according to the premixed combustion burner 18 of the present embodiment, since the injection holes 24*a*, 24*b*, 25*a* and 25*b* are provided in the positions displaced from each other in the directions of vane height and/or vane length of the swirler vane 20 (in offset positions), a reduction in fuel supply pressure can be prevented, and stable fuel injection can be carried out.

Furthermore, according to the premixed combustion burner 18 of the present embodiment, since the diameters of the injection holes 24*a* and 25*a* positioned on the radial direction outer side are set greater than the diameters of the injection holes 24*b* and 25*b* positioned on the radial direction inner side, fuel concentration in the air passageway 23 in the radial direction can be made more uniform, and the occurrence of flash back (back fire) can be more reliably prevented.

Furthermore, according to the premixed combustion burner 18 of the present embodiment, since the chamfers 31 and 32 are provided in the rear edge section of the swirler vane 20, and a spiral flow is generated at the rear of these chamfers 31 and 32 to promote mixing of the layer of the compressed air A and the spiral air flow "a", fuel concentration in the air passageway 23 in the radial direction can be made more uniform, further preventing the occurrence of flash back (back fire).

Figure 6A:
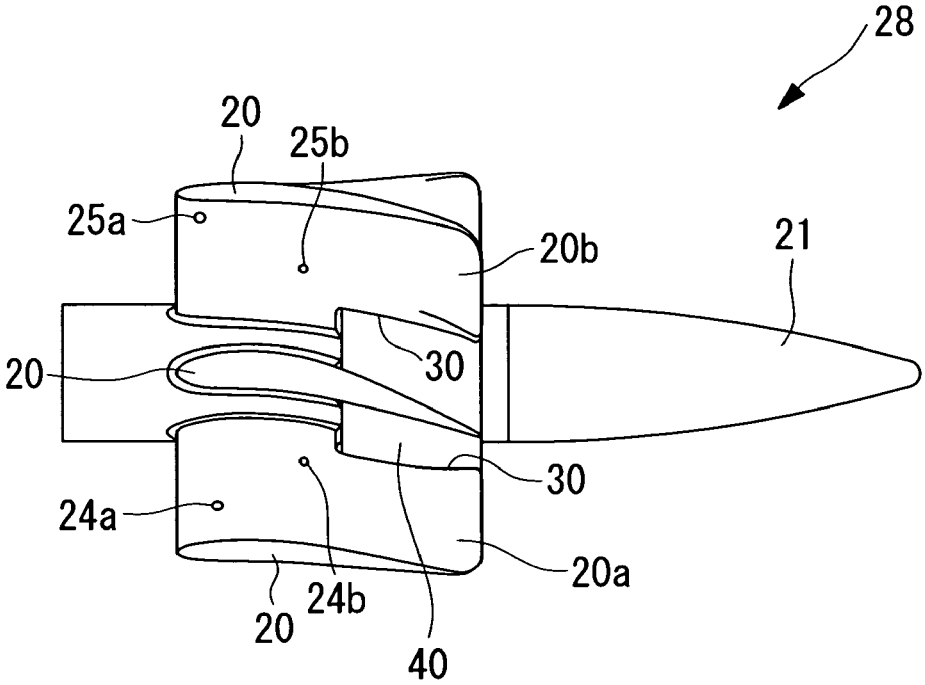
FIGS. 6 (*a*) and (*b*) are diagrams showing a second embodiment of the premixed combustion burner according to the present invention, (a) being a side view of the swirler vanes and the fuel nozzles, and (b) being a front view thereof.
Figure 6B:
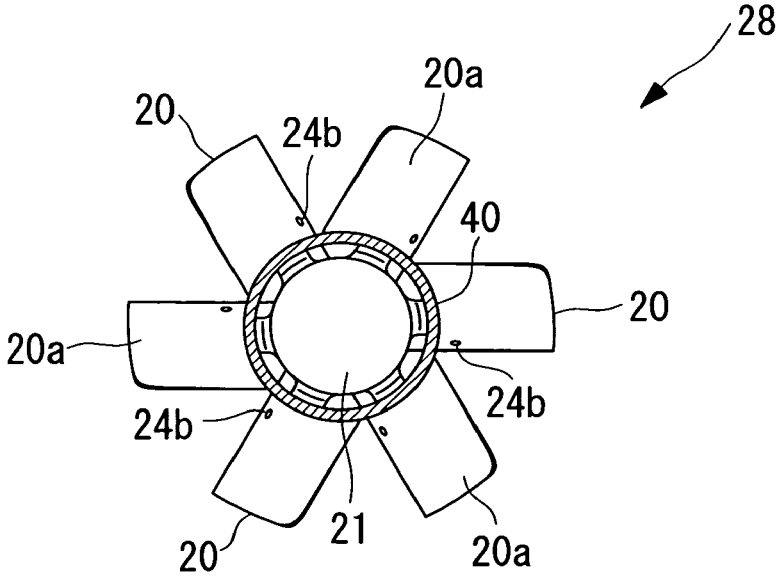

A second embodiment of the premixed combustion burner according to the present invention is described, with reference to FIG. 6 (*a*) and FIG. 6 (*b*).

A premixed combustion burner 28 according to the present embodiment differs from the premixed combustion burner of the first embodiment in that a ring member 40 is provided on the inner circumference side (radial direction inside) of the cutaway section 30. Since other components are the same as those in the first embodiment, descriptions thereof are omitted here.

The ring member 40 is a plate-shaped member having a sectional ring shape (refer to FIG. 6 (*b*)) provided so as to be in contact with an inner circumference side end surface of the cutaway section 30 from the end surface of the front edge side, to the rear edge, of the cutaway section 30. As a result, the inner circumference side and the outer circumference side of the air passageway 23 are separated (divided).

According to the premixed combustion burner 28 of the present embodiment, since the spiral force acting on the inner circumference side of the air passageway 23 is weakened by the ring member 40, enhancing the effect of the cutaway section 30 and thereby promoting the mixing of the layer of the compressed air A and the spiral air flow "a", fuel concentration in the air passageway 23 in the radial direction can be made more uniform, and the occurrence of flash back (back fire) can be further prevented.

Moreover, since the entire inner circumference side of the cutaway section 30 is held (supported) by the ring member 40, the rigidity of the entire swirler vane 20 can be enhanced.

Since other effects are the same as those of the first embodiment, description thereof is omitted here.

Figure 7:
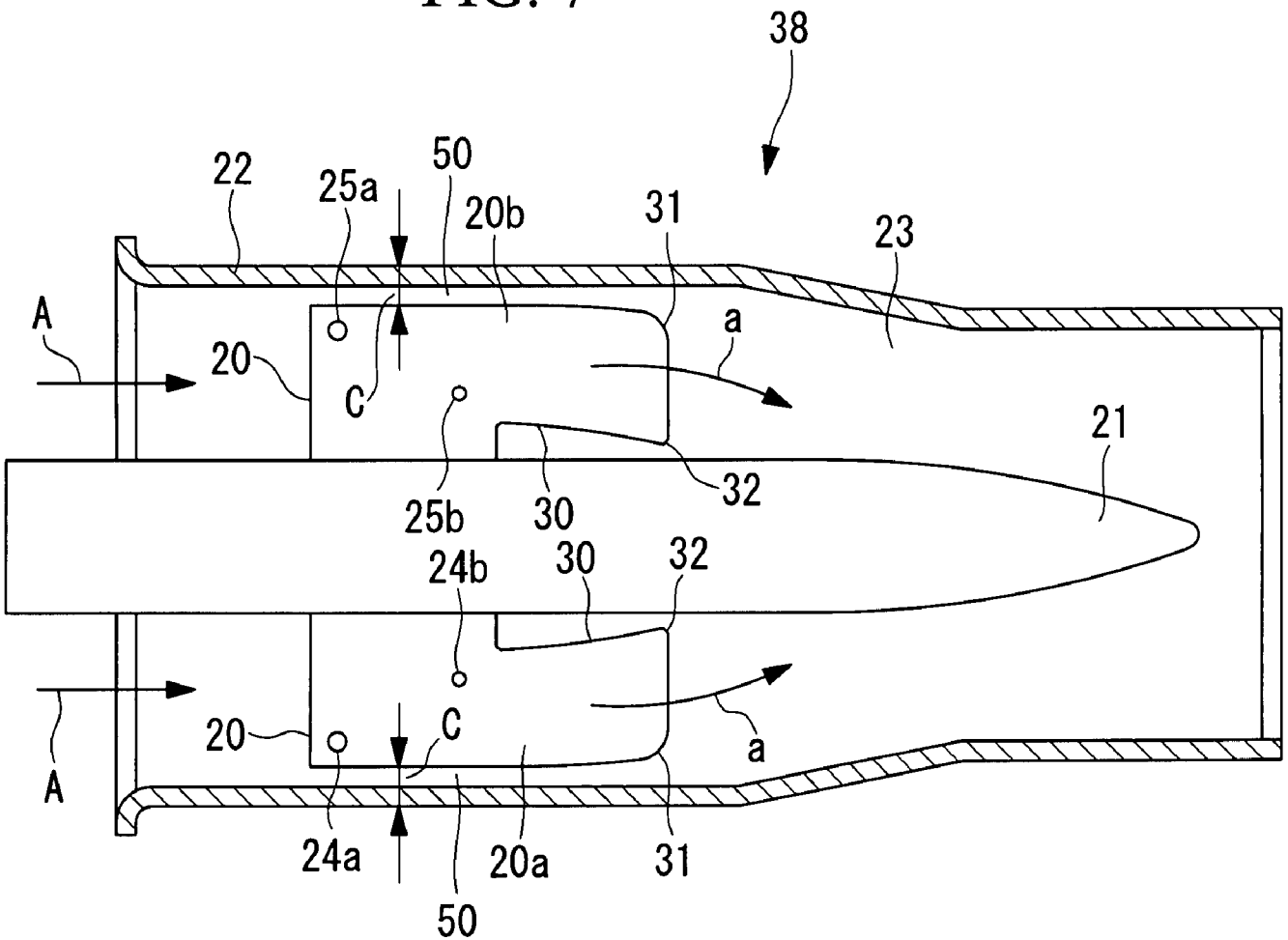
FIG. 7 is a schematic diagram showing a third embodiment of the premixed combustion burner according to the present invention.

A third embodiment of the premixed combustion burner according to the present invention is described, with reference to FIG. 7.

A premixed combustion burner 38 according to the present embodiment differs from the premixed combustion burner of the first embodiment in that a clearance (gap) 50 is provided between an outer circumference side end surface (tip) of each of the swirler vanes 20 and an inner surface of the burner cylinder 22. Since other components are the same as those in the first embodiment, descriptions thereof are omitted here.

The clearance 50 is provided in an area from the front edge to the rear edge of each of the swirler vanes 20, and its length C in the vane height direction is respectively set equal to the height h of the cutaway section 30, that is, 3% to 20% (preferably approximately 15%) of the maximum vane height H of the swirler vane 20.

Incidentally, the pressure on the vane back side surface 20*a* of the swirler vane 20 is low, and the pressure on the vane front side surface 20*b* is high, so that there is a pressure difference between the vane back side surface 20*a* and the vane front side surface 20*b*. Therefore, an air leak flow occurs, traveling through the clearance 50 and approaching the vane back side surface 20*a* from the vane front side surface 20*b*. This leak flow and the compressed air A flowing within the air passageway 23 in the axial direction act on each other and generate a spiral air flow. This spiral air flow effectively mixes the fuel injected from the injection holes 24*a*, 24*b*, 25*a* and 25*b* with air, promoting uniformity of fuel gas.

According to the premixed combustion burner 38 of the present embodiment, since the clearance 50 provides efficient mixing of fuel and air to promote uniformity of the fuel gas, fuel concentration in the air passageway 23 in the radial direction can be made more uniform, and the occurrence of flash back (back fire) can be further prevented.

Since other effects are the same as those of the first embodiment, description thereof is omitted here.

Figure 8:
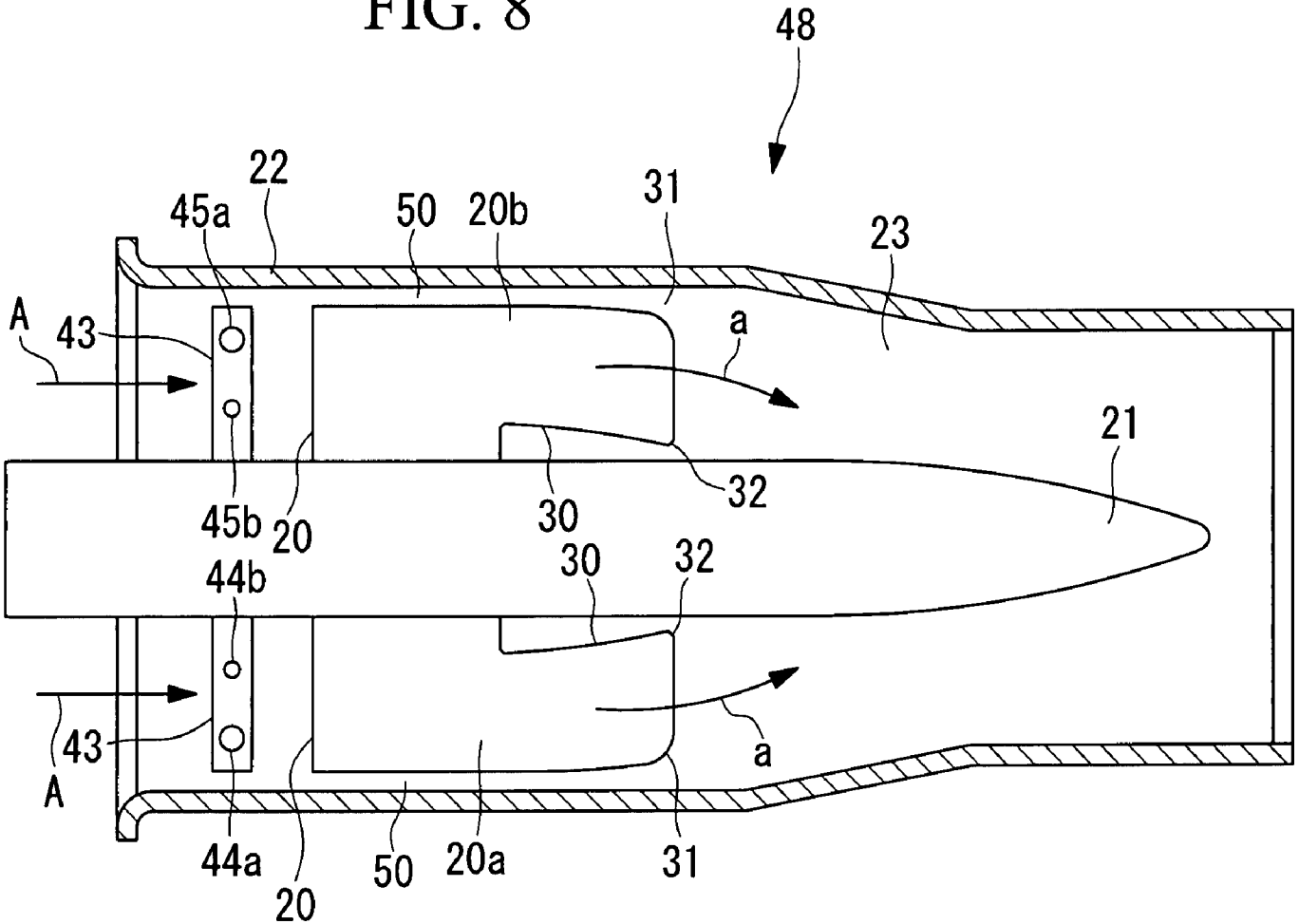
FIG. 8 is a schematic diagram showing a fourth embodiment of the premixed combustion burner according to the present invention.

A fourth embodiment of the premixed combustion burner according to the present invention is described, with reference to FIG. 8.

A premixed combustion burner 48 according to the present embodiment differs from the aforementioned premixed combustion burner of the third embodiment in that injection holes 44*a*, 44*b*, 45*a* and 45*b* are provided instead of the injection holes 24*a*, 24*b*, 25*a* and 25*b*. Since other components are the same as those in the third embodiment, descriptions thereof are omitted here.

The injection holes 44*a* and 44*b* are formed on one surface (the surface on the same side as the vane back side surface 20*a* of the swirler vane 20) of a peg (fuel injection device) 43, and the injection holes 45*a* and 45*b* are formed in the other surface (the surface on the same side as the vane front side surface of the swirler vane 20) of the peg 43. As shown in FIG. 8, the injection holes 44*a* and 45*a* are provided on the outer circumference side (radial direction outer side: side further from the fuel nozzle 21) of the peg 43, and the injection holes 44*b* and 45*b* are provided on the inner circumference side (radial direction inner side: side closer to the fuel nozzle 21) of the peg 43. Moreover, the injection holes 44*a*, 44*b*, 45*a* and 45*b* are provided in positions displaced from one another in the height direction and/or the width (axial) direction of the peg 43 (offset positions).

The diameters of the injection holes 44*a* and 45*a* are respectively greater than the diameters of the injection holes 44*b* and 45*b*, and the diameters of the injection hole 44*a* and injection hole 45*a* are of substantially equal size, and the diameters of the injection hole 44*b* and injection hole 45*b* are of substantially equal size. Moreover, fuel is supplied respectively to these injection holes 44*a*, 44*b*, 45*a* and 45*b* through a fuel passageway (not shown in the diagram) formed inside the peg 43, and through a fuel passageway (not shown in the diagram) formed inside the fuel nozzle 21. The fuel injected from the injection holes 44*a*, 44*b*, 45*a* and 45*b* is mixed with the compressed air A and becomes fuel gas, which is sent into an interior space of the inner cylinder 15 to be combusted.

According to the premixed combustion burner 48 of the present embodiment, since processing of the injection holes 24*a*, 24*b*, 25*a* and 25*b* for a complex shaped swirler vane 20 is no longer required, an amount of time required for the processing operation of the injection holes 24*a*, 24*b*, 25*a* and 25*b* can be shortened and a reduction in production cost achieved.

Since other effects are the same as those of the third embodiment, description thereof is omitted here.

The present invention is not limited to the embodiments described above, and for example, the ring member 40 described in the second embodiment may be applied to the configuration described for the third and fourth embodiments, and the peg 43 described in the fourth embodiment may be applied to the configuration described for the first and second embodiments.

What is claimed is:

1. A premixed combustion burner for a gas turbine comprising:

a fuel nozzle;

a burner cylinder arranged so as to surround said fuel nozzle and form an air passageway between itself and said fuel nozzle; and a plurality of swirler vanes arranged along an axial direction of said fuel nozzle in a plurality of positions around a circumferential direction of an outer circumference surface of said fuel nozzle and that gradually curve from an upstream side to a downstream side to spin air traveling within the air passageway from the upstream side to the downstream side, wherein each of said swirler vanes has a forward section located at the upstream side that is connected to said fuel nozzle and a rear section located at the downstream side that has a cutaway section provided at a rear edge section on an inner circumference side, wherein said cutaway section provides a gap between the rear edge section of each of said swirler vanes and the outer circumference surface of said fuel nozzle.

2. A premixed combustion burner for a gas turbine according to claim 1, wherein a height of each of said cutaway sections is set to 3% to 20% of a maximum vane height of said swirler vanes.

3. A premixed combustion burner for a gas turbine according to claim 2, wherein each of said swirler vanes has a plurality of injection holes for fuel injection provided in a vane back side surface and/or a vane front side surface, and, for each of said swirler vanes, a diameter of an injection hole of said injection holes positioned at a radial direction outer side is greater than a diameter of another injection hole of said injection holes positioned at a radial direction inner side.

4. A premixed combustion burner for a gas turbine according to claim 3, wherein, for each of said swirler vanes, said other injection hole positioned at the radial direction inner side is provided at a position proximal to said cutaway section and enables fuel injected from said other injection hole to flow along the vane back side surface and/or the vane front side surface of said respective swirler vane to a rear edge of said respective swirler vane.

5. A premixed combustion burner for a gas turbine according to claim 4, wherein, for each of said swirler vanes, said injection holes are provided in positions that are displaced from one another in a vane height direction and/or a vane length direction of said respective swirler vane.

6. A premixed combustion burner for a gas turbine according to claim 3, wherein, for each of said swirler vanes, said injection holes are provided in positions that are displaced from one another in a vane height direction and/or a vane length direction of said respective swirler vane.

7. A premixed combustion burner for a gas turbine according to claim 2, wherein each of said swirler vanes has a chamfer section provided on a rear edge section tip side and/or on a root side.

8. A premixed combustion burner for a gas turbine according to claim 2, further comprising a ring member provided on a radial direction inner side of said cutaway sections of said swirler vanes.

9. A premixed combustion burner for a gas turbine according to claim 2, wherein outer circumference side end surfaces of said swirler vanes and an inner surface of said burner cylinder have a clearance provided therebetween.

10. A combustor of a gas turbine comprising a premixed combustion burner for a gas turbine according to claim 2.

11. A gas turbine comprising a combustor of a gas turbine according to claim 10.

12. A premixed combustion burner for a gas turbine according to claim 1, wherein each of said swirler vanes has a plurality of injection holes for fuel injection provided in a vane back side surface and/or a vane front side surface, and, for each of said swirler vanes, a diameter of an injection hole of said injection holes positioned at a radial direction outer side is greater than a diameter of another injection hole of said injection holes positioned at a radial direction inner side.

13. A premixed combustion burner for a gas turbine according to claim 12, wherein, for each of said swirler vanes, said other injection hole positioned at the radial direction inner side is provided at a position proximal to said cutaway section and enables fuel injected from said other injection hole to flow along the vane back side surface and/or the vane front side surface of said respective swirler vane to a rear edge of said respective swirler vane.

14. A premixed combustion burner for a gas turbine according to claim 13, wherein, for each of said swirler vanes, said injection holes are provided in positions that are displaced from one another in a vane height direction and/or a vane length direction of said respective swirler vane.

15. A premixed combustion burner for a gas turbine according to claim 12, wherein, for each of said swirler vanes, said injection holes are provided in positions that are displaced from one another in a vane height direction and/or a vane length direction of said respective swirler vane.

16. A premixed combustion burner for a gas turbine according to claim 1, wherein each of said swirler vanes has a chamfer section provided on a rear edge section tip side and/or on a root side.

17. A premixed combustion burner for a gas turbine according to claim 1, further comprising a ring member provided on a radial direction inner side of said cutaway sections of said swirler vanes.

18. A premixed combustion burner for a gas turbine according to claim 1, wherein outer circumference side end surfaces of said swirler vanes and an inner surface of said burner cylinder have a clearance provided therebetween.

19. A combustor of a gas turbine comprising a premixed combustion burner for a gas turbine according to claim 1.

20. A gas turbine comprising a combustor of a gas turbine according to claim 19.

* * * * *